US011225969B2

(12) United States Patent
Her et al.

(10) Patent No.: US 11,225,969 B2
(45) Date of Patent: Jan. 18, 2022

(54) MOTOR-OPERATED COMPRESSOR

(71) Applicant: LG ELECTRONICS INC., Seoul (KR)

(72) Inventors: Jongtae Her, Seoul (KR); Dongwoo Min, Seoul (KR); Gyeongbeom Lee, Seoul (KR); Byeongchul Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 103 days.

(21) Appl. No.: 16/733,384

(22) Filed: Jan. 3, 2020

(65) Prior Publication Data

US 2020/0217316 A1 Jul. 9, 2020

(30) Foreign Application Priority Data

Jan. 7, 2019 (KR) ..... 10-2019-0001829

(51) Int. Cl.
*F04C 18/02* (2006.01)
*F04C 29/00* (2006.01)

(52) U.S. Cl.
CPC ..... *F04C 18/0215* (2013.01); *F04C 29/0092* (2013.01)

(58) Field of Classification Search
CPC .. F04C 18/0215; F04C 27/00; F04C 29/0092; F04C 29/12; F04C 2240/30;
(Continued)

(56) References Cited

U.S. PATENT DOCUMENTS 4,928,503 A * 5/1990 Riffe ..... F04C 18/0215 251/61.2
6,135,738 A * 10/2000 Kajiwara ..... F04C 18/0215 418/55.4

(Continued)

FOREIGN PATENT DOCUMENTS

JP 2007-270696 10/2007
KR 10-2014-0136796 12/2014

(Continued)

*Primary Examiner* — Audrey B. Walter
*Assistant Examiner* — Dapinder Singh
(74) *Attorney, Agent, or Firm* — Finnegan, Henderson, Farabow, Garrett & Dunner, LLP

(57) ABSTRACT

A motor-operated compressor includes a compression part including a fixed scroll and an orbiting scroll that form a compression chamber configured to compress fluid by an orbiting motion of the orbiting scroll relative to the fixed scroll. A motor part is disposed at one side of the compression part, and configured to generate a drive force to cause the orbiting scroll to make the orbiting motion. A rotary shaft is connected to the motor part and the orbiting scroll to transmit the drive force generated by the motor part to the orbiting scroll. A main frame is disposed between the compression part and the motor part in an axial direction of the rotary shaft, and configured to support the fixed scroll in the axial direction of the rotary shaft. A discharge chamber is formed between the fixed scroll and the main frame, and fluid discharged from the compression part passes through the discharge chamber to outside of the motor-operated compressor.

20 Claims, 5 Drawing Sheets

(58) Field of Classification Search
CPC ..... F04C 2240/40; F04C 2240/60; F04C 2240/809; F01C 21/02
USPC ..... 418/55.1–55.6
See application file for complete search history.

(56) References Cited

U.S. PATENT DOCUMENTS

| | | | | |
|---|---|---|---|---|
| 7,708,536 | B2 * | 5/2010 | Ginies | F04C 23/008 418/55.6 |
| 2004/0191083 | A1 * | 9/2004 | Gennami | F04C 23/008 417/310 |
| 2014/0348680 | A1 * | 11/2014 | Lee | F04C 29/12 418/55.2 |
| 2015/0192127 | A1 * | 7/2015 | Nagano | F04C 28/24 417/410.5 |
| 2019/0211820 | A1 * | 7/2019 | Bush | F04C 2/02 |

FOREIGN PATENT DOCUMENTS

| | | |
|---|---|---|
| KR | 10-2018-0103368 | 9/2018 |
| KR | 10-2018-0117470 | 10/2018 |

* cited by examiner

MOTOR-OPERATED COMPRESSOR

CROSS-REFERENCE TO RELATED APPLICATION

Pursuant to 35 U.S.C. § 119(a), this application claims the benefit of earlier filing date and right of priority to Korean Application No. 10-2019-0001829, filed on Jan. 7, 2019, the entire contents of which is incorporated by reference herein in its entirety.

BACKGROUND

1. Field

The present disclosure relates to a motor-operated compressor driven by electricity using a motor.

2. Background

Compressors are divided into mechanical systems with engines as a driving source and electric systems driven by electricity using a motor.

The scroll compression method suitable for high-voltage operation is widely known for electric compressors. In the scroll type electric compressor (hereinafter, referred to as a 'motor-operated compressor'), a motor part formed as a drive motor is installed inside a closed casing. And a compression part including a fixed scroll and an orbiting scroll is installed on one side of the motor part. And the motor part and the compression part are connected by a rotary shaft so that a rotational force of the motor part is transmitted to the compression part. And the compression part compresses fluid such as refrigerant by a rotational force received through the rotary shaft.

The motor-operated compressors are mounted on electric vehicles and may be used to constitute a refrigeration cycle of the electric vehicles. In motor-operated compressors, noise and vibration may be induced by various factors, such as operation of the driving motor, rotation of the rotary shaft, compression movement of the compression part, and flow of fluid compressed by high pressure. Generally, electric vehicles have advantages of no noise and vibration from the engine, and when vibration of an electric compressor is transmitted through the vehicle body to the rider, it will cause a reduction in ride quality.

As disclosed in the patent document, Korea Patent Laid-Open Publication No. 10-2014-0136796], the structure of sucking fluid from the top of the compressor and discharging the compressed fluid back to the top of the compressor is disclosed. Discharging of high pressure refrigerant from the eccentric position to one side, such as the top or bottom of the compressor, causes the compressor to pulsate and increase the noise and vibration.

On the other hand, the compressor uses the back pressure structure to seal the compression chamber. In the Korea Patent Laid-Open Publication No. 10-2018-0103368 (2018.09.19.), the structure to reduce the discharged fluid to intermediate pressure and use it for back pressure is disclosed. However, separate depressurization devices or decompression flow paths are required to depressurize the fluid discharged by discharge pressure to intermediate pressure. In addition, when pressure is not sufficiently reduced, the difference between the discharge pressure and the intermediate pressure is insufficient, making it difficult to form the complete intermediate pressure ideally required by the back pressure structure.

SUMMARY

Therefore, an aspect of the detailed description is to provide a motor-operated compressor to suppress the generation of noise and vibration through a structure that can reduce pulsation generated from compressors.

Another aspect of the detailed description is to provide a motor-operated compressor with a structure that can seal the compression chamber at a complete intermediate pressure.

To achieve these and other advantages and in accordance with the purpose of this specification, as embodied and broadly described herein, a motor-operated compressor in accordance with one embodiment of the detailed description includes a main frame disposed between a compression part and a motor part in an axial direction of a rotary shaft, a discharge chamber formed between the compression part and the main frame; and a discharge part installed in the main frame, and configured to communicate with the outside of the motor-operated compressor and the discharge chamber, respectively, so that fluid discharged from the compression part to the discharge chamber is discharged to the outside of the motor-operated compressor.

The discharge chamber is formed to be supplied with high pressure fluid discharged from the compression part.

The compression part includes a fixed scroll and an orbiting scroll that form the compression chamber, and is configured to compress the fluid through an orbiting motion of the orbiting scroll relative to the fixed scroll.

The motor part is mounted on one side of the compression part and configured to generate a driving force to rotate the orbiting scroll.

The rotary shaft is connected to the motor part and the orbiting scroll, respectively so as to transmit the driving force generated by the motor part to the orbiting scroll of the compression part.

The main frame is formed to support the fixed scroll of the compression part in an axial direction.

The discharge chamber is formed in an annular form covering the rotary shaft, the main frame includes a main frame-side suction flow path that supplies fluid to be compressed from the motor part to the compression chamber, and the main frame-side suction flow path is formed between an outer edge of the discharge chamber and an outer edge of the main frame in a radial direction of the rotary shaft.

A fixed scroll-side suction flow path is formed at a position that faces the main frame-side suction flow path in the axial direction on a fixed plate of the fixed scroll.

At least one of the fixed scroll and the main frame includes a partition wall that forms the outer edge of the discharge chamber.

The partition wall has a section in a form of a closed curve to isolate the discharge chamber from the main frame-side suction flow path and the fixed scroll-side suction flow path.

An o-ring is installed at least one of between the fixed plate and the partition wall and between the main frame and the partition wall.

The fixed scroll includes a rotary shaft accommodation part formed to enclose the rotary shaft, the rotary shaft accommodation part is inserted into the main frame, and a sealing member formed to enclose the rotary shaft accommodation part is installed between an outer circumferential surface of the rotary shaft and an inner circumferential surface of the main frame.

The fixed scroll includes a fixed plate, and the fixed plate includes a fixed scroll-side discharge flow path that causes the fluid compressed at the compression chamber to be discharged into the discharge chamber, the motor-operated compressor further includes a discharge valve, and the discharge valve is formed to open and close the fixed scroll-side discharge flow path and disposed between the fixed plate and the main frame.

The main frame includes an oil separator formed to separate oil from the fluid entering the discharge part from the discharge chamber; an oil separating chamber formed below the oil separator to collect oil separated by the oil separator; and a main frame-side oil hole penetrating through one side of the main frame in the axial direction to supply the oil collected at the oil separation chamber towards the fixed scroll.

The discharge chamber is formed in an annular form covering the rotary shaft, and the main frame-side oil hole is formed between an outer edge of the discharge chamber and an outer edge of the main frame in a radial direction of the rotary shaft.

A rotary shaft-side oil feeding flow path is formed on a hollow part of the rotary shaft, and the fixed scroll includes a fixed scroll-side oil feeding flow path that causes the oil supplied from the oil separation chamber through the oil hole to be supplied to the rotary shaft-side oil feeding flow path.

The fixed scroll-side oil feeding flow path passes through the fixed plate of the fixed scroll in the radial direction of the rotary shaft, an inlet of the fixed scroll-side oil feeding flow path is disposed to face the main frame-side oil hole in the axial direction, and an outlet of the fixed scroll-side oil feeding flow path is disposed to face an inlet of the rotary shaft-side oil feeding flow path in the radial direction of the rotary shaft.

At least one of the fixed scroll and the main frame includes a projection protruded towards the other in the axial direction of the rotary shaft, and at least one of an inlet of the oil hole and the inlet of the rotary shaft-side oil feeding flow path is formed on the projection.

The projection is formed on outside of the discharge chamber in the radial direction of the rotary shaft.

The motor-operated compressor includes a main housing exposed to the outside of the motor-operated compressor and formed to enclose the motor part; and a middle housing exposed to the outside of the motor-operated compressor and formed to enclose the compression part, and the main frame is exposed to the outside of the motor-operated compressor between the main housing and the middle housing in the axial direction to form external appearance of the motor-operated compressor together with the main housing and the middle housing.

The motor-operated compressor further includes a rear housing, the rear housing is configured to cover the orbiting scroll and disposed opposite to the fixed scroll with respect to the orbiting scroll, to form an intermediate pressure chamber between the rear housing and an orbiting plate provided to the orbiting scroll, the orbiting plate includes an intermediate pressure discharge flow path, and the intermediate pressure discharge flow path communicates the compression chamber with the intermediate pressure chamber to discharge fluid of an intermediate pressure between suction pressure and discharge pressure of the fluid from the compression chamber to the intermediate pressure chamber.

DETAILED DESCRIPTION

Hereinafter, a motor according to the present disclosure will be described in detail with reference to the accompanying drawings.

Hereinafter, a motor-operated compressor according to the present disclosure will be described in detail with reference to the accompanying drawings.

For the sake of brief description with reference to the drawings, the same or equivalent components will be provided with the same reference numbers, and description thereof will not be repeated.

It will be understood that when an element is referred to as being "connected with" another element, the element can be connected with the another element or intervening elements may also be present. In contrast, when an element is referred to as being "directly connected with" another element, there are no intervening elements present.

A singular representation may include a plural representation unless it represents a definitely different meaning from the context.

Figure 1:
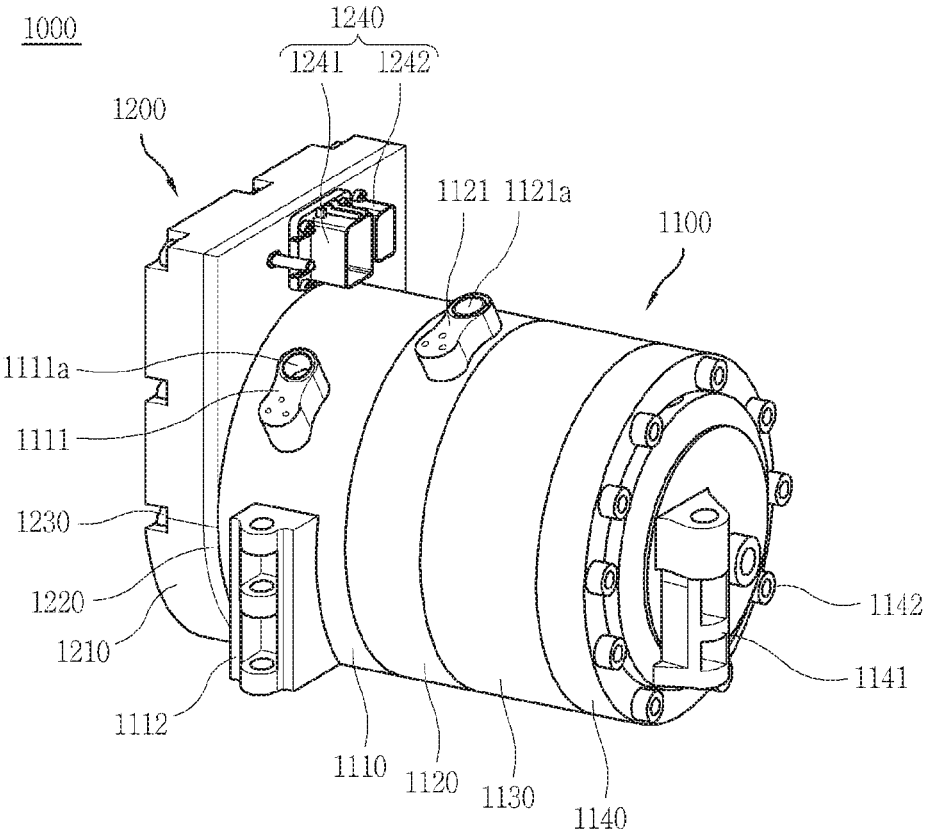
FIG. 1 is a perspective view illustrating an external appearance of the motor-operated compressor proposed in the detailed description of the present disclosure.

FIG. 1 is a perspective view illustrating an external appearance of the motor-operated compressor 1000 proposed in the detailed description of the present disclosure.

The motor-operated compressor 1000 includes a compression module 1100 and an inverter module 1200.

The compression module 1100 refers to a set of parts for compressing fluids such as refrigerant. The inverter module 200 refers to a set of parts to control the operation of the compression module 1100. The inverter module 1200 may be coupled to one side of the compression module 1100. When orientation is established based on the flow of fluid compressed by the motor-operated compressor 1000, one side of the compression module 1100 means the front side of the compression module 1100. Since the fluid to be compressed is introduced into an inlet 1111*a* and discharged through an outlet 1121*a*, the inverter module 1200, which is disposed close to the inlet 1111*a*, may be described as coupled to the front side of the compression module 1100.

The appearance of the compression module 1110 may be formed by the main housing 1110, the main frame 1120, the middle housing 1130 and the rear housing 1140. The main housing 1110, the main frame 1120, the middle housing 1130, and the rear housing 1140 are arranged sequentially from the front to the rear of the motor-operated compressor 1000.

The main housing 1110 has an appearance of a hollow column, a multi-column, or equivalences thereof. The main housing 1110 may be disposed to extend in the lateral direction. The main housing 1110 is formed to enclose the motor part 1150 which will be described later. The ends of the main housing 1110 may be opened. Here the front end of the main housing 1110 is an end that is coupled to the inverter module 1200. And the rear end of the main housing 1110 means an end that is coupled to the main frame 1120.

The outer circumferential surface of the main housing 1110 forms a suction part 1111 and a mounting part 1112.

The suction part 1111 forms a flow path that supplies the fluid to be compressed to the inner space of the compression module 1100. The suction part 1111 may protrude from an outer circumferential surface of the main housing 1110. The suction part 1111 may be connected to a suction pipe (not shown), that supplies the fluid to be compressed to the motor-operated compressor 1000. The suction part 1111 has the shape corresponding to the suction pipe to be combined with the suction pipe, and a suction hole 1111*a* is formed in the suction part 1111.

The mounting part 1112 is a configuration for securing the motor-operated compressor 1000 to the region to be installed. The mounting part 1112 may protrude from an outer circumferential surface of the main housing 1110. The mounting part 1112 may protrude along the circumference of the main housing 1110. The mounting part 1112 may be extended in the tangent direction of the outer circumferential surface of the main housing 1110.

The mounting part 1112 may include a coupling member binding hole that is capable of being coupled with any coupling member. The coupling member binding hole may be opened in the tangent direction on the outer circumferential surface of the main housing 1110. The mounting part 1112 may be formed on one side of the main housing 1110 and on the other side thereof, respectively. For example, in FIG. 1, the mounting part 1112 is formed on the left and right sides or on the upper and lower sides of the main housing 1110, respectively.

The main frame 1120 is disposed on the rear side of the main housing 1110. The main frame 1120 may have an external diameter corresponding to the outer diameter of the main housing 1110, or have an external diameter that comes close to that of the main housing 1110. The main frame 1120 is a configuration that supports the fixed scroll 1161 of the compression part 1160 that will be described later, and does not necessarily require to be exposed to the outside of the compression module 1100. However, in the detailed description of the disclosure, the discharge part 1121 is formed in the main frame 1120, so at least part of the main frame 1120 has to be exposed to the outside of the compression module 1100.

The discharge part 1121 is formed so that fluid compressed at the motor-operated compressor 1000 is discharged to the outside. The discharge part 1121 may include a protrusion on the outer circumferential surface of the main frame 1120. The discharge part 11121 may be connected to the discharge pipe (not shown) which supplies fluid compressed at the motor-operated compressor 1000 to the next unit of the refrigeration cycle. The discharge part 1121 includes a discharge hole 1121*a* and has the shape corresponding to the discharge pipe to be combined therewith.

The middle housing 1130 has an appearance of a hollow column, a multi-column, or equivalences thereof. The middle housing 1130 may be disposed to extend in the lateral direction. The middle housing 1130 is formed to enclose the compression part 1160. The ends of the middle housing 1130 may be opened. Here the front end of the middle housing 1130 means an end that is coupled to the main frame 1120. And the rear end of the middle housing 1130 means an end that is coupled to the rear housing 1140.

The outer circumferential surface of the main housing 1110 forms a suction part 1111 and a mounting part 1112.

The rear housing 1140 is installed on the rear side of the middle housing 1130. The rear housing 1140 may be formed to cover the rear end of the middle housing 1130.

The rear housing 1140 includes a mounting part 1141.

The mounting part 1141 is formed on a rear outer surface of the rear housing 1140 at the rear side. The mounting part 1141 may protrude from the rear outer surface of the rear housing 1140. The mounting part 1141 may be extended in the upward and downward directions. The mounting part 1141 has substantially the same function as the mounting part 1112 of the main housing 1110.

The main housing 1110, the main frame 1120, the middle housing 1130 and the rear housing 1140 may be coupled together by a plurality of coupling members 1142. The coupling members 1142 are inserted from the rear housing 1140 towards the main housing 1110. The coupling members 1142 may be installed along the circumference of the rear housing 1140 so as to be spaced apart from each other.

The appearance of the inverter module 1200 is formed by the inverter housing 1210 and the inverter cover 1220.

The inverter housing 1210 and the inverter cover 1220 are coupled together to form mounting spaces for circuit parts and the like.

The inverter housing 1210 is disposed at the front end of the motor-operated compressor 1000. One side of the inverter housing 1210 is disposed to be faced towards the motor-operated compressor 1000 and forms one outer wall of the motor-operated compressor 1000. The inverter housing 1210 is equipped with side walls, which protrude towards the inverter cover 1220 along the edge of one surface. The inverter housing 1210 may have a larger outer circumferential surface than the outer circumferential surface of the main housing 1110.

The inverter cover 1220 is coupled to the inverter housing 1210. The inverter cover 1220 is disposed between the inverter housing 1210 and the main housing 1110. The inverter cover 1220 may be formed in a plate shape covering an opening of the inverter housing 1210 and the front end of the main housing 1110. The edge of the inverter cover 1220 may have a shape corresponding to the side wall of the inverter housing 1210.

The inverter housing 1210 and the inverter cover 1220 are coupled together by a plurality of coupling members 1230. A plurality of coupling members 1230 is inserted from the inverter housing 1210 towards the inverter cover 1220. A plurality of coupling members 1230 is installed in locations separated from each other along the circumference of the inverter housing 1210.

The inverter cover 1220 is equipped with a connector 1240. The connector 1240 includes a power connector 1241 and a communication connector 1242. The power connector 1241 and the communication connector 1242 are formed to allow connection with different counterpart connectors, respectively. The power connector 1241 is configured to transmit power from the counterpart connector to circuit components. The communication connector 1242 is configured to electrically transmit control commands, etc. from the outside, to the circuit components to enable the motor-operated compressor 1000 to be operated according to the control commands.

Hereinafter, description will be given of the internal structure of the motor-operated compressor 1000.

Figure 2:
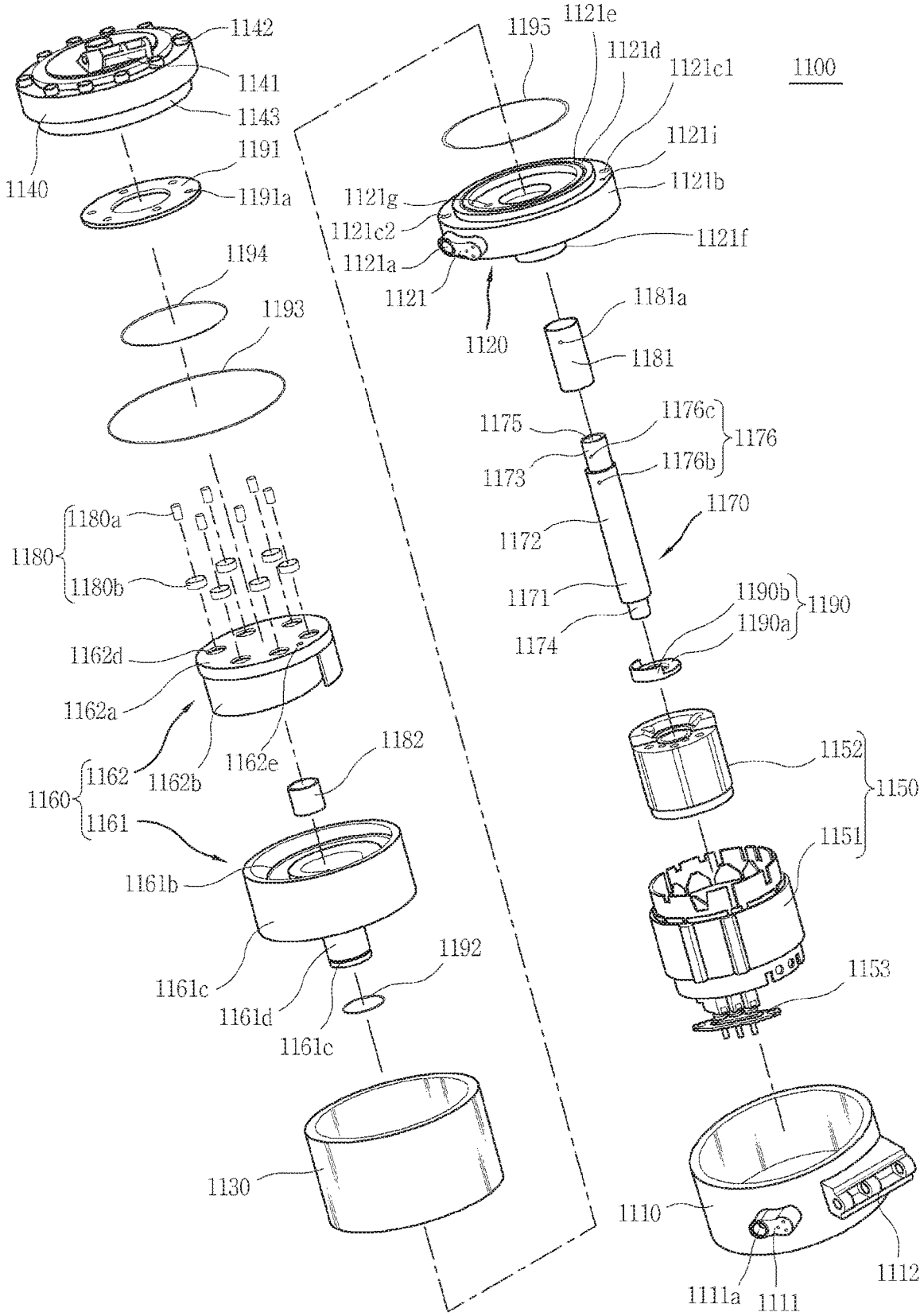
FIG. 2 is a disassembled perspective view of the motor-operated compressor of FIG. 1.
Figure 3:
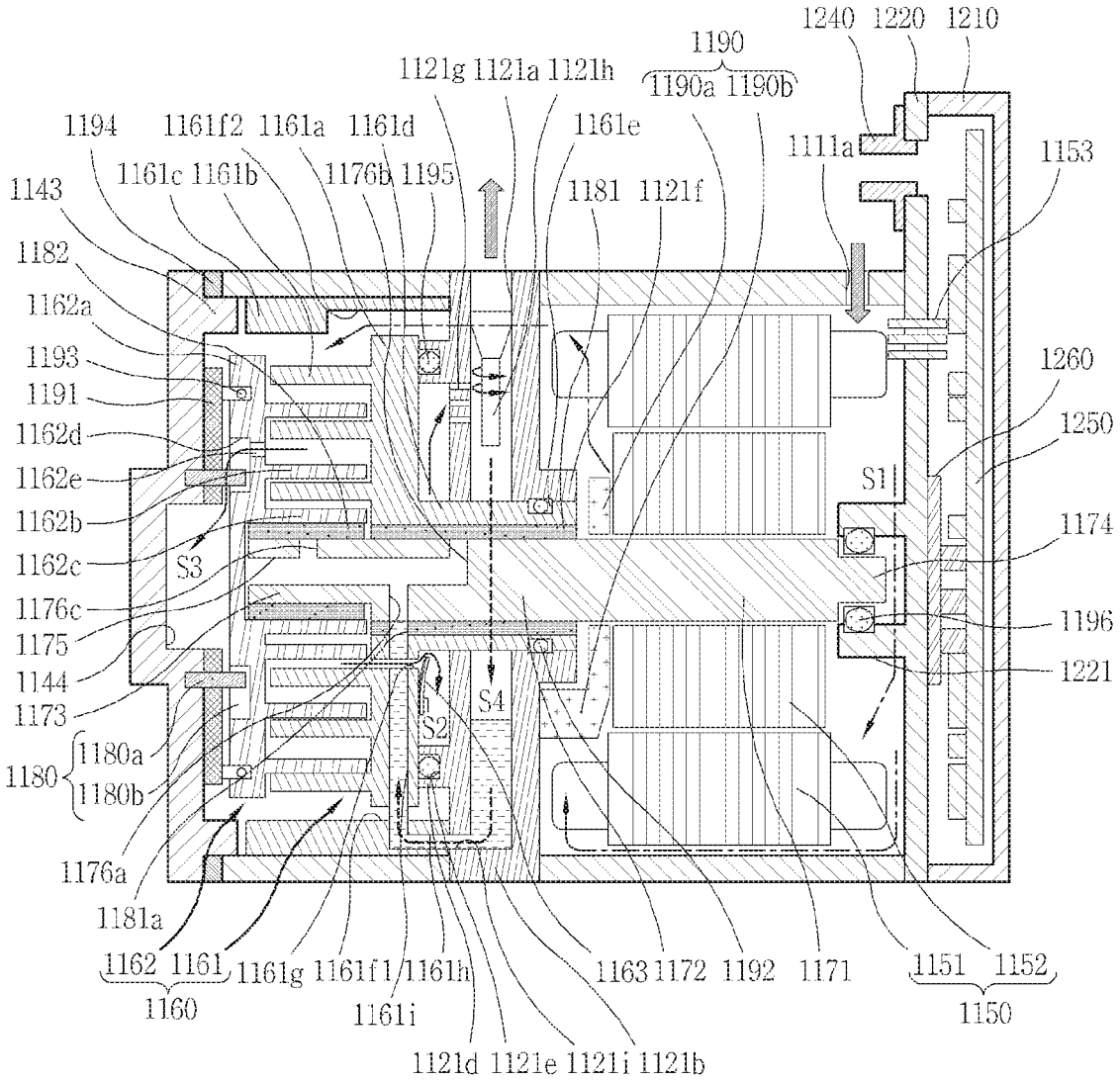
FIG. 3 is a sectional view of the motor-operated compressor of FIG. 1.

FIG. 2 is a disassembled perspective view of the compression module 1100 of the motor-operated compressor 1000 of FIG. 1, and FIG. 3 is a sectional view of the motor-operated compressor of FIG. 1.

The motor-operated compressor 1000 includes a compression module 1100 and an inverter module 1200.

The compression module 1110 includes a main housing 1110, a motor part 1150 (drive unit or drive motor), a compressor 1160, a rotary shaft 1170, bush bearings 1181 and 1182, a rear housing 1140, an anti-rotation device 1180, a rear housing 1140, a main frame 1120, and various sealing members 1192, 1193, 1194 and 1195.

First, the main housing 1110 is described.

Both the front and rear ends of the main housing 1110 are openings. In this case, the front end refers to the inverter module 1200 side and the rear end to the main frame 1120 side. The front end may be referred to as a first end and the rear end may be referred to as a second end. The front end of the main housing 1110 is coupled to the inverter module 1200 and the rear end of the main housing 1110 is coupled to the main frame 1120.

The main housing 1110 forms a motor chamber (S1). The motor chamber (S1) means a space in which the motor part 1150 is installed. The main housing 1110 is configured to accommodate the motor part 1150 in the motor chamber (S1). The motor part 1150 is installed in the motor chamber (S1) of the main housing 1110. An inverter module 1200 is installed at the front end of the main housing 1110 and the inverter module 1200 for sealing of the motor chamber (S1), and the main frame 1120 is installed at the rear end of the main housing 1110.

Hereinafter, description will be given of the motor part 1150.

The motor part 1150 is formed to generate a driving force for orbiting motion of the orbiting scroll 1160 of the compression part 1160. The motor part 1150 is configured by a drive motor. The drive motor is installed in the motor chamber (S1). The drive motor includes a stator 1151 and a rotor 1152.

The stator 1151 is installed along the inner circumferential surface of the main housing 1110. The stator 1151 is secured to the inner circumferential surface of the main housing 1110. The stator 1151 is inserted and secured in the main housing 1110 with a shrinkage fitting (or press-fit).

Setting the insertion depth (or length) of the stator 1151 inserted in the main housing 1110 small (or shallow) is advantageous in securing ease of assembly work for the stator 1151. Furthermore, the small insertion depth of the stator 1151 is advantageous in maintaining the concentricity of the stator 1151 in the shrinkage fitting process of the stator 1151.

The stator 1151 is electrically connected to the power device 1260 of the inverter module 1200 by a three-phase terminal 1153. The power device 1260 is connected to a printed circuit board 1250. The three-phase terminal 1153 may be installed at the rear end of the stator 1151. The three-phase terminal 1153 penetrates the inverter cover 1220

The rotor 1152 is installed in the region covered by the stator 1151. When power is applied to the stator 1151 through the three-phase terminal 1153, the rotor 1152 is rotated by electromagnetic interaction with the stator 1151.

Hereinafter, description will be given of the compression part 1160.

The compression part 1160 is configured to compress fluid to be compressed such as refrigerant. The compression part 1160 is formed on the rear side of the motor part 1150. The compression part 1160 includes a fixed scroll 1161 and an orbiting scroll 1162. The compression part 1160 is formed by the fixed scroll 1161 and the orbiting scroll 1162. The fixed scroll 1161 and the orbiting scroll 1162 may be named a first scroll and a second scroll, respectively.

The fixed scroll 1161 and the orbiting scroll 1162 are coupled together to form a pair of compression chambers. The volume of the compression chamber varies repeatedly as the orbiting scroll 1162 rotates, thereby compressing fluid such as refrigerant in the compression chamber.

The fixed scroll 1161 is disposed relatively close to the motor part 1150, while orbiting scroll 1162 is disposed relatively far from the motor part 1150. The fixed scroll 1162 is disposed between the orbiting scroll 1162 and the main housing 1110 in the axial direction. The orbiting scroll 1162 is disposed between the fixed scroll 1161 and the rear housing 1140 in the axial direction.

The fixed scroll 1161 is mounted on the inside of the middle housing 1130. The fixed scroll 1161 is supported by the middle housing 1130 in the radial direction of rotary shaft 1170. And the fixed scroll 1161 is supported by the main frame 1120 in the axial direction of the rotary shaft 1170.

The fixed scroll 1161 is disposed at a position that corresponds to the bearing part 1172 of the rotary shaft 1170. The rotary shaft 1170 penetrates the fixed scroll 1161.

The orbiting scroll 1162 is disposed at a position facing the fixed scroll 1161. The orbiting scroll 1162 is coupled to an eccentric part 1173 of the rotary shaft 1170. As a result, the orbiting scroll 1162 is coupled in an eccentric manner to the rotary shaft 1170. The orbiting scroll 1162 which receives a rotational force through the eccentric part 1173 makes an orbiting motion by the anti-rotation device 1180.

Detailed structure of the fixed scroll will be described with reference to FIGS. 2 and 3, and in addition to FIG. 4.

Figure 4:
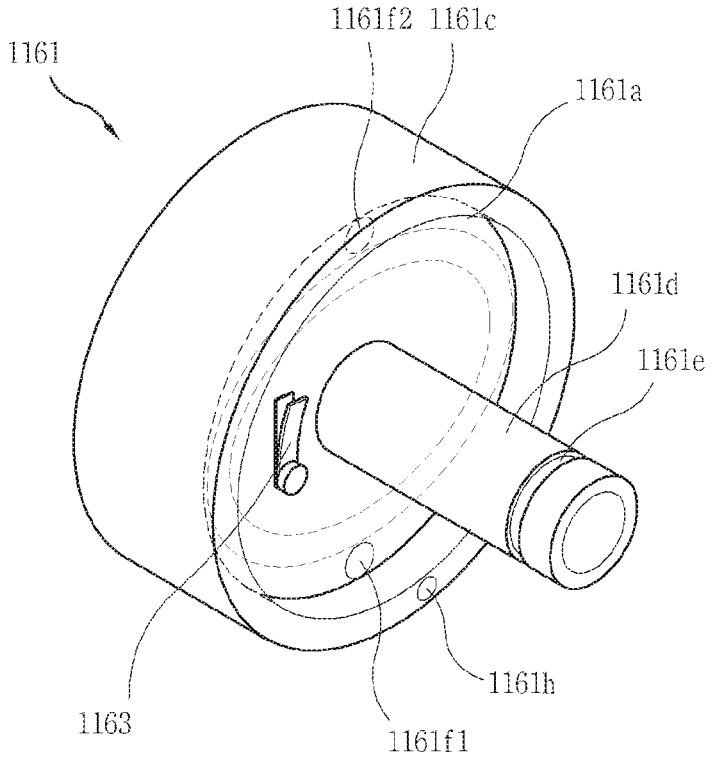
FIG. 4 is a perspective view of a fixed scroll.

FIG. 4 is a perspective view of the fixed scroll 1161.

The fixed scroll 1161 includes a fixed plate part 1161*a*, a fixed wrap 1161*b*, a side wall 1161*c*, a rotary shaft accommodation part 1161*d*, a sealing member accommodation part 1161*e*, fixed scroll-side suction flow paths 1161*f*1 and 1161*f*2, a fixed scroll-side discharge flow path 1161*g*, a fixed scroll-side oil hole 1161*h*, and a fixed scroll-side oil feeding flow path 1161*i*.

The fixed plate 1161*a* is formed in the form of a plate facing the base 1121*b* of the main frame 1120 in a position spaced apart from the base 1121*b*. The fixed plate 1161*a* may have a cross-section of a circle, in which case the fixed plate 1161*a* may have the shape of a circular plate.

When the plane facing the main frame 1120 on either side of the fixed plate 1161*a* is referred to as a first plane, and the plane facing the orbiting scroll 1162 is referred to as a second plane, the rotary shaft accommodation hole 1161*d* is formed on the first plane, and the fixed wrap 1161*b* is formed on the second plane.

The fixed wrap 1161*b* protrudes into the shape of an involute curve, an arithmetic spiral (Archimedean spiral), or an algebraic spiral (log spiral, Logarithmic spiral) towards the orbiting scroll 1162. The involute curve means the curve corresponding to the trajectory drawn by the end of the thread when unwinding by pulling the thread without loosening up wrapped around a basic circle with an arbitrary radius. The arithmetic spiral means a trace drawn by a moving point when the moving point is separated from a reference point at a constant speed along a straight line that rotates at a certain angular speed around a fixed reference point. And the algebraic spiral is a curve that follows a constant logarithmic function in the polar coordinates. The fixed wrap 1161*b* may be formed in a variety of other shapes.

The fixed wrap 1161*b* engages with the orbiting wrap 1162*b* to form a compression chamber. The fixed wrap 1161*b* is inserted between the orbiting wrap 1162*b*, and the orbiting wrap 1162*b* is inserted between the fixed wrap 1161*b*.

The side wall 1161*c* protrudes towards the side of the orbiting scroll 1162, along the edge of the fixed plate 1161*a*. The side wall 1161*c* is formed to enclose the fixed wrap 1161*b* in the radial direction of the fixed scroll 1161.

The side wall 1161*c* may also protrude towards the main frame 1120. For example, as shown in FIG. 3, the side wall 1161*c* protrudes towards the main frame 1120 in close contact with the base 1121*b* of the main frame 1120. On the contrary, the main frame 1120 may protrude towards the side wall 1161*c*.

The outer circumferential surface of the side wall 1161*c* is in close contact with the inner circumferential surface of the middle housing 1130. The fixed scroll 1161 may therefore be secured to the inside of the middle housing 1130.

The rotary shaft accommodation part 1161*d* is formed at the center of the fixed plate 1161*a*. The rotary shaft accommodation part 1161*d* protrudes axially from the fixed plate 1161*a* towards the main housing 1110. The rotary shaft accommodation part 1161*d* is inserted into the main frame 1120.

The rotary shaft accommodation part 1161*d* is formed to enclose and accommodate therein the bearing part 1172 of the rotary shaft 1170. The rotary shaft accommodation part 1161*d* may be formed in the hollow cylindrical shape.

The sealing member accommodation part 1161*e* is formed on an outer circumferential surface of the rotary shaft accommodation part 1161*d*. The sealing member accommodation part 1161*e* is formed by being recessed on the outer circumferential surface of the rotary shaft accommodation part 1161*d* in an axial direction. The sealing member accommodation part 1161*e* is equipped with a sealing member 1192 to seal an oil separation chamber (S4) which will be described later. The sealing member 1192 is formed to enclose the outer circumferential surface of the rotary shaft accommodation part 1161*d*.

The fixed scroll-side suction flow paths 1161*f*1 and 1161*f*2 are formed in the fixed plate 1161*a*. The fixed scroll-side suction flow paths 1161*f*1 and 1161*f*2 include a hole that penetrates the fixed plate 1161*a* in an axial direction. The fixed scroll-side suction flow paths 1161*f*1 and 1161*f*2 have the configurations that supply fluid to be compressed flowing into the motor chamber (S1) through the suction part 1111 to the compression part 1160.

The fixed scroll-side suction flow paths 1161*f*1 and 1161*f*2 are formed in the position facing the main frame-side suction flow paths 1121*c*1 and 1121*c*2 formed on the main frame 1120 in an axial direction. Based on the radial direction of the rotary shaft 1170, the fixed scroll-side suction flow paths 1161*f*1 and 1161*f*2 are formed radially outward form a partition wall 1121*d* which will be described later, and radially inwards from the side wall 1161*c* of the fixed scroll 1161*c*.

The fixed scroll-side suction flow paths 1161*f*1 and 1161*f*2 may be formed in a plural number. The plural fixed scroll-side suction flow paths 1161*f*2 and 1161*f*2 may be formed opposite to each other based on the rotary shaft accommodation part 1161*d* in the radial direction of the rotary shaft 1170.

The fixed scroll-side discharge flow path 1161*g* is formed on the fixed plate 1161*a*. The fixed scroll-side flow path 1161*g* includes a hole that penetrates the fixed plate 1161*a* in an axial direction. The fixed scroll-side flow path 1161*g* is configured to discharge fluid compressed at the compression part 1160 into the discharge chamber (S2).

The fixed scroll-side discharge flow path 1161*g* is formed in the position corresponding to the discharge chamber (S2) in the axial direction of the rotary shaft 1170. The fixed scroll-side discharge flow path 1161*g* is formed on the inside of a partition wall 1121*d*, which will be described later, based on the radial direction of the rotary shaft 1170.

Between the fixed scroll 1161 and the main frame 1120, a discharge valve 1163 is installed to open and close the fixed scroll-side discharge flow path 1161*g*.

The discharge valve 1163 is formed to be opened above a preset pressure and closed below the preset pressure. The discharge valve 1163 is installed in the fixed plate 1161*a* of the fixed scroll 1161. The discharge valve 1163 is installed in the discharge chamber (S2).

The fixed scroll-side oil hole 1161*h* is formed on the fixed plate 1161*a* or the side wall 1161*c*. The fixed scroll-side oil hole 1161*h* is opened to one side towards the main frame 1120. In the radial direction of the rotary shaft 1170, the fixed scroll-side oil hole 1161*h* is formed outside of the partition wall 1121*d*, and formed at the same position as or formed on an inside of the side wall 1161*c* of the fixed scroll 1161*c*.

The fixed scroll-side oil hole 1161*h* is formed to face the main frame-side oil hole 1121*i* in an axial direction. The fixed scroll-side oil hole 1161*h* corresponds to the inlet of the fixed scroll-side oil feeding flow path 1161*i*. The fixed scroll-side oil hole 1161*h* may be in close contact with the main frame-side oil hole 1121*i*.

The fixed scroll-side oil feeding flow path 1161*i* is formed on the downstream side of the fixed scroll-side oil hole 1161*h*. The fixed scroll-side oil feeding flow path 1161*i* penetrates part of the side wall 1161*c* in an axial direction, and part of the fixed plate 1161*a* in the radial direction of the rotary shaft 1170. The outlet of the fixed scroll-side oil feeding flow path 1161*i* is formed to be exposed to the inner circumferential surface of the fixed scroll 1161.

Bush bearings 1181 and 1182 and/or the rotary shaft 1170 are disposed on an inner circumferential surface of the fixed scroll 1161. Oil from the oil separation chamber (S4) formed in the main frame 1120 is supplied to the bush bearings 1181 and 1182 and the rotary shaft 1170 through the fixed scroll-side oil hole 1161*h* and the fixed scroll-side oil feeding flow path 1161*i*.

Referring back to FIGS. 2 and 3, description will be given of the orbiting scroll 1162.

The orbiting scroll 1162 includes an orbiting plate 1162*a*, an orbiting wrap 1162*b*, a rotary shaft accommodation part 1162*c*, an anti-rotation device settling groove 1162*d*, and an intermediate pressure discharge flow path 1162*e*.

The orbiting plate 1162*a* is formed in the shape of a plate corresponding to the fixed plate 1161*a*. When the orbiting plate 1162*a* has a section corresponding to a circle, the orbiting plate 1162*a* has the shape of a circular plate.

The orbiting plate 1162*a* may have an outer diameter smaller than the side wall 1161*c* of the fixed scroll 1161*a*. Accordingly, the orbiting plate 1162*a* may be fixedly mounted on the fixed wrap 1161*b* of the fixed scroll 1161. The orbiting plate 1162*a* and the fixed wrap 1161*b* may form a thrust plane.

When the plane facing the fixed scroll 1161 on either side of the orbiting plate 1162*a* is referred to as a first plane, and the plane facing the rear housing 1140 is referred to as a second plane, the orbiting wrap 1162*b* is formed on the first plane, and the anti-rotation device mounting groove 1162*d* is formed on the second plane.

The orbiting wrap 1162*b* protrudes into the shape of an involute curve, an arithmetic spiral (Archimedean spiral), or an algebraic spiral (Logarithmic spiral), from the first plane of the orbiting plate 1162*a* towards the fixed scroll 1161. The orbiting wrap 1162*b* may be formed into a variety of other shapes.

The orbiting wrap 1162*b* may be in close contact with the fixed plate 1161*a*. Similarly, the fixed wrap 1161*b* may also be in close contact with the orbiting plate 1162*a*. On at least one of an axial end of the fixed wrap 1161*b* and an axial end of the orbiting wrap 1162*b*, a tip seal may be mounted to seal the compression chamber.

The rotary shaft accommodation part 1162*c* is formed at the center of the orbiting plate 1162*a*. The rotary shaft accommodation part 1162*c* protrudes towards the fixed scroll 1161 from the first plane of the orbiting plate 1162*a*. The rotary shaft accommodation part 1162*c* may be formed in a position corresponding to the basic circle of the involute shape defining the orbiting wrap 1162*b*. Accordingly, the rotary shaft accommodation part 1162*c* forms the innermost part of the orbiting wrap 1162*b*.

The rotary shaft accommodation part 1162*c* is formed in a hollow cylindrical shape to accommodate therein an eccentric part 1173 of the rotary shaft 1170. The rotary shaft accommodation part 1162*c* is formed to enclose the eccentric part 1173 of the rotary shaft 1170.

The rotary shaft accommodation part 1161*d* of fixed scroll 1161 fully penetrates the fixed plate 1161*a*, whereas the rotary shaft accommodation part 1162*c* of the orbiting scroll 1162*c* is opened on only one side. For example, the rotary shaft accommodation part 1162*c* of the orbiting scroll 1162*a* is opened towards the fixed scroll 1161, but the opposite side of the opening is blocked by the orbiting plate 1162*a*. Thus, the eccentric part 1173 of rotary shaft 1170 is inserted into the rotary shaft accommodation part 1162*c* of the orbiting scroll, but does not penetrate the orbiting plate 1162*a*.

The anti-rotation device mounting groove 1162*d* is formed on the second plane of the orbiting plate 1162*a*. The anti-rotation device mounting groove 1162*d* is formed by being recessed in the axial direction on the second plane of the orbiting plate 1162*a*. The anti-rotation device mounting groove 1162*d* may be formed in a plural number. The plurality of anti-rotation device mounting grooves 1162*d* is formed on locations spaced apart from each other along either virtual circumference of the second plane.

The intermediate pressure discharge flow path 1162*e* is formed to penetrate the orbiting plate 1162*a* in the axial direction or in the direction slant to the axial direction of the rotary shaft 1170. The intermediate pressure discharge flow path 1162*e* communicates the compression chamber and the intermediate pressure chamber (S3) to allow the intermediate-pressure fluid to be discharged into the intermediate pressure chamber (S3) formed between the orbiting scroll 1162 and the rear housing 1140. The intermediate pressure discharge flow path 1162*e* is formed externally in the radial direction of the rotary shaft 1170 than the fixed scroll-side discharge flow path (1161*f*2) and inwards in the fixed scroll-side suction flow paths 1161*f*1 and 1161*f*2. Therefore, the pressure of the fluid discharged from the intermediate pressure discharge flow path 1162*e* to the intermediate pressure chamber (S3) is between suction pressure and discharge pressure of the fluid.

Hereinafter, description will be given of the rotary shaft 1170.

The rotary shaft 1170 is coupled to the rotor 1152, the fixed scroll 1161, and the orbiting scroll 1162. The rotary shaft 1170) transmits the rotational force generated by the driving motor to the compression part 1160, while rotating with the rotor 1152. The rotary shaft 1170 is inserted and secured to the rotor 1152 by means of shrinkage fitting (or press fitting).

The rotary shaft 1170 is extended from the front to the rear of the motor-operated compressor 1000. The direction in which the rotary shaft 1170 is extended is the axial direction of the rotary shaft 1170. The rotary shaft 1170 is connected to the motor part 1150 and the orbiting scroll 1162, respectively, to transmit the driving force generated by the motor part 1150 to the orbiting scroll 1162.

The rotary shaft 1170 includes a drive motor coupling part 1171, a bearing part 1172 and an eccentric part 1173.

The drive motor coupling part 1171 is coupled to the rotor 1152. The drive motor coupling part 1171 is extended in the axial direction of the rotary shaft 1170 through the center of the rotor 1152.

The bearing part 1172 corresponds to the rear side of the drive motor coupling part 1171. The bearing part 1172 is extended from the drive motor coupling part 1171 in an axial direction. The bearing part 1172 may have a different external diameter than the drive motor coupling part 1171. The center of the bearing part 1172 corresponds to the center of the drive motor coupling part 1171.

The bearing part 1172 is inserted into the rotary shaft accommodation part 1161*d* of the fixed scroll 1161*d* which will be described later. The bearing part 1172 penetrates the rotary shaft accommodation part 1161*d*. The circumference of the bearing part 1172 is rotatably supported by the rotary shaft accommodation part 1161*d* in the radial direction of the rotary shaft 1170.

The eccentric part 1173 corresponds to the rear side of the bearing part 1172. The eccentric part 1173 is extended from the bearing part 1172 in an axial direction. The eccentric part 1173 may have an outer diameter smaller than the bearing part 1172.

The center of the eccentric part 1173 is inconsistent with the center of the bearing part 1172. Thus, the center of the eccentric part 1173 is formed in the axial direction of the rotary shaft 1170 at the center of the drive motor coupling part 1171 or the center of the bearing part 1172. The eccentric part 1173 is formed at the rear end of the rotary shaft 1170. The eccentric part 1173 is inserted into the rotary shaft accommodation part 1161*d* of the orbiting scroll 1162, which will be described later.

The front end of the rotary shaft 1170 is supported by a rotary shaft support part 1121 that is formed on the inverter module 1200. The rotary shaft support part 1121 protrudes from the inverter cover 1220 or the inverter housing 1210 towards the motor chamber (S1). The rotary shaft support part 1121 is formed to rotatably support the front end of the rotary shaft 1170 in an axial direction.

The front end of the rotary shaft 1170 may have a smaller outer diameter compared to the drive motor coupling part 1171. A bearing 1196 may be installed between the front end of the rotary shaft 1174 and the rotary shaft support part 1121. The bearing 1196 may be formed to enclose the rotary shaft 1170. The bearing 1196 may include ball bearings.

On the rotary shaft 1170, a rotary shaft-side oil feeding flow path 1175 and an oil hole 1176 are formed.

The rotary shaft-side oil feeding flow path 1175 is formed by being recessed at the rear end of the rotary shaft 1170 in an axial direction. And the oil feeding hole 1176 is formed at the rotary shaft-side oil feeding flow path 1175 towards the axial direction of the rotary shaft. The oil feeding hole 1176 may be formed in a plural number, and a plurality of oil feeding holes 1176 is formed on positions spaced apart from each other in the axial direction of the rotary shaft 1170.

A first oil feeding hole 1176*a* is disposed to face the oil feeding hole 1181*a* formed at a first bush bearing 1181*a*. The first oil feeding hole 1176*a* receives oil from the fixed scroll-side oil feeding flow path 1161*i* through the oil feeding hole 1181*a* of the first bush bearing 1181. Oil supplied to the first oil feeding hole 1176*a* is supplied to the second oil feeding hole 1176*b* and the third oil feeding hole 1176*c* through the rotary shaft-side oil feeding flow path 1175.

The second oil feeding hole 1176*b* is disposed so as to face the inner circumferential surface of the first bush bearing 11181. The third oil feeding hole 1176*c* is then disposed so as to face the inner circumferential surface of the second bush bearing 1182. The oil supplied to the rotary shaft-side oil feeding flow path 1175 is supplied between the outer circumferential surface of the rotary shaft 1170 and the inner circumferential surfaces of the two bush bearings 11811 and 1182 through the second oil feeding hole 1176*b* and the third oil feeding hole 1176*c*. The oil supplied to the second oil feeding hole 1176*b* and the third oil feeding hole 1176*c* lubricates the bearing surfaces between the rotary shaft 1170 and the two bearings 1181 and 1182.

The first bush bearing 1181 is inserted into the rotary shaft accommodation part 1161*d* of the fixed scroll 1161. The outer circumferential surface of the first bush bearing 11181 is in close contact with the inner circumferential surface of the rotary shaft accommodation part 1161*d*. The first bush bearing 1181 is secured to the rotary shaft accommodation part 1161*d*.

The first bush bearing 1181 is formed in a hollow column to enclose the bearing part 1172 of the rotary shaft 1170. The bearing part 1172 is inserted into the first bush bearing 1181. The rotary shaft 1170 rotates relative to the first bush bearing 1181. The inner circumferential surface of the first bush bearing 1181 and the outer circumferential surface of the bearing part 1172 form the bearing surface.

The oil feeding hole 1181*a* is formed on the first bush bearing 1181. The oil feeding hole 1181*a* of the first bush bearing 1181 is opened in the radial direction of the rotary shaft 1170. On the outer circumferential surface of the first bush bearing 1181, the oil feeding hole 1181*a* is disposed to face the fixed scroll-side oil feeding flow path 1161*i* formed in the fixed scroll 1161, and the oil feeding hole 1181*a* is disposed to face the first oil feeding hole 1176*a* of the rotary shaft 1170 on the inner circumferential surface of the first bush bearing 1181.

Accordingly, oil supplied from the fixed scroll-side oil feeding flow path 1161*i* is supplied to the rotary shaft-side oil feeding low path 1175 through the oil feeding hole 1181*a* of the first bush bearing 1181*a* and the first oil feeding hole 1176*a* of the rotary shaft 1170.

The second bush bearing 1182 is inserted into the rotary shaft accommodation part 1162*c* of the orbiting scroll 1162. The outer circumferential surface of the second bush bearing 1182 is in close contact with the inner circumferential surface of the rotary shaft accommodation part 1162*c*. The second bush bearing 1182 is secured to the rotary shaft accommodation part 1162*c*.

The second bush bearing 1182 is formed in a hollow column to enclose the eccentric part 1173 of the rotary shaft 1170. The eccentric part 1173 is inserted into the second bush bearing 1182. The rotary shaft 1170 rotates relative to the second bush bearing 1182. The inner circumferential surface of the second bush bearing 1182 and the outer circumferential surface of the eccentric part 1173 form the bearing surface.

A balance weight 1190 is coupled to the rotary shaft 1170. The balance weight 1190 is installed to offset the eccentric load (or eccentricity) of the rotary shaft 1170. The balance weight 1190 includes a ring part 1190*a* and an eccentric mass part 1190*b*.

The ring part 1190*a* is formed in the ring shape enclosing the rotary shaft 1170. The outer diameter of the ring part 1190*a* is greater than that of the rotary shaft 1170.

The eccentric mass part 1190*b* is extended from the edge of the ring part 1190*a* in an axial direction or parallel to the axial direction. The eccentric mass part 1190*b* protrudes in the axial direction from an arc having a constant center angle among 360° of the edge of the ring part 1190*a*. Accordingly, the eccentric mass part 1190*b* partially encloses the rotary shaft 1170 in a position spaced apart from the rotary shaft 1170.

Description will be given of the anti-rotation device 1180.

The anti-rotation device 1180 is configured to rotate the orbiting scroll 1162 in an orbiting manner. Without an anti-rotation device 1180, the orbiting scroll 1162 may be rotated by the drive force transmitted by the rotary shaft 1170. The anti-rotation device 1180 prevents rotation of the orbiting scroll 1162, and causes the orbiting scroll 1162 to make an orbiting motion.

An anti-rotation device 1180 may be formed by multiple pins and rings. The ring 1180*b* is inserted into an anti-rotation device mounting groove 1162*d* of the orbiting scroll 1162. The open sides of the ring 1180*b* are disposed towards the front and rear of the motor-operated compressor 1000, respectively. Each pin 1180*a* is joined to each ring 1180*b*. The pin 1180*a* is disposed towards the front and rear of the motor-operated compressor 1000. One end of the pin 1180*a* is inserted in the region covered by the ring 1180*b*, and the other end of the pin 1180*a* is inserted in the rear housing 1140. The rear housing 1140 is provided with an accommodation part (not shown) to accommodate therein the pins 1180*a*.

The anti-rotation device 1180 does not necessarily have to be formed of the pin and ring, but may consist of a variety of instruments, such as an Oldham ring.

On the other hand, the rear housing 1140 is formed to cover the orbiting scroll 1162. The rear housing 1140 may include an annular projection 1143, which is inserted into the middle housing 1130. The outer circumferential surface of the annular protrusion 1143 is in close contact with the inner circumferential surface of the middle housing 1130.

The sealing member 1193 may be disposed between the rear housing 1140 and the middle housing 1130. The sealing member 1193 may be formed in an annular o-ring. The sealing member 1193 may be formed to enclose the annular protrusion 1143. The sealing member 1193 may be pressed by the rear housing 1140 and the middle housing 1130.

The rear housing 1140 is disposed on the opposite side of the fixed scroll 1161, relative to the orbiting scroll 1162. The intermediate pressure chamber (S3) is formed between the rear housing 1140 and the orbiting scroll 1162. In particular, the rear housing 1140 may include a recess 1144 to form the intermediate pressure chamber (S3). The recess 1144 is recessed in a direction away from the orbiting plate 1162*a* of the orbiting scroll 1162 to form an intermediate pressure chamber (S3) between the fixed plate 1161*a*.

A thrust plate 1191 is disposed between the orbiting scroll 1162 and the rear housing 1140. The thrust plate 1191 may be formed as an annular plate. The thrust plate 1191 forms an orbiting surface with the orbiting scroll 1162. The thrust plate 1191 may be formed of a Teflon® material.

The thrust plate 1191*a* may include a plurality of holes 1191*a* through which the pins of the anti-rotation device 1180*a* may penetrate. The plurality of holes 1191*a* may be formed on the position facing the anti-rotation device mounting groove 1162*d* formed in the fixed scroll 1161 in the axial direction of the rotary shaft 1170.

A sealing member 1194 to seal the intermediate pressure chamber (S3) may be installed between the thrust plate 1191 and the orbiting plate 1162*a* of the orbiting scroll 1162. The sealing member 1194 may be formed by an annular o-ring.

Hereinafter, description will be given of the main frame 1120.

The main frame 1120 will be described with reference to FIGS. 2 and 3 and additionally to FIG. 5.

Figure 5:
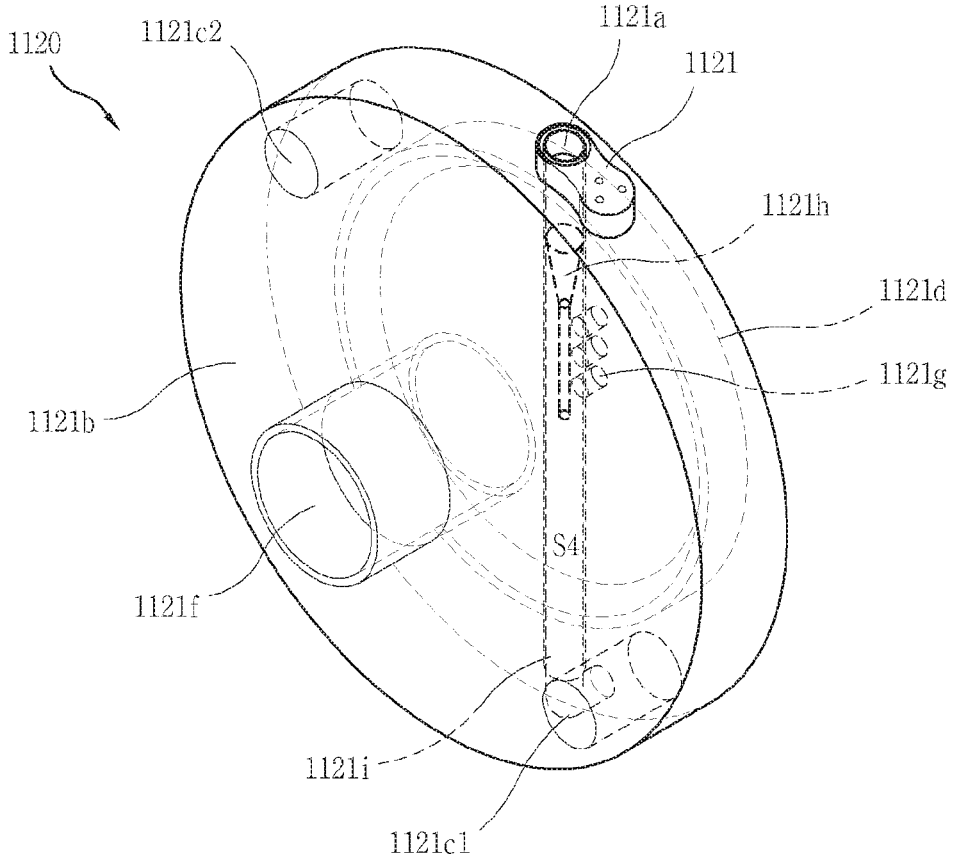
FIG. 5 is a perspective view of a main frame.

FIG. 5 is a perspective view of the main frame 1120.

The main frame 1120 is disposed between the compression part 1160 and the motor part 1150 in the axial direction of the rotary shaft 1170. Specifically, the main frame 1120 is coupled to the rear end of the main housing 1110. The main frame 1120, the main housing 1110, and the inverter module 1200 are coupled together to form the motor chamber (S1) as described earlier.

The main frame 1120 is also coupled to the front end of the middle housing 1130. The main frame 1120 is configured to support the fixed scroll 1161 in the axial direction. The main frame 1120 is installed on the front side of the fixed scroll 1161.

The main frame 1120 includes a discharge part 1121, a base 1121*b*, main frame-side suction flow paths 1121*c*1 and 1121*c*2, a partition wall 1121*d*, a sealing member accommodation part 1121*e*, a fixed scroll accommodation part 1121*f*, a communication hole 1121*g*, an oil separator 1121*h*, and a main frame-side oil hole 1121*i*.

The discharge part 1121 is configured to separate oil from high-pressure fluid flowed from the discharge chamber (S2) to the oil separation chamber (S4) through the communication hole 1121*g*, and to discharge the remaining fluid (mainly refrigerant) into the discharge outlet 1121*a*. For example, the fluid compressed at the compression part 1160 is discharged to the discharge chamber (S2), and the fluid discharged to the discharge chamber (S2) is transferred back to the oil separation chamber (S4) via the communication hole 1121*g*. The outlet 1121*a* of the discharge part 1121 is connected to the oil separation chamber (S4) and the discharge chamber (S2), so the high-pressure fluid may be discharged to the outside of the motor-operated compressor 1000 through the outlet 1121*a*.

The base 1121*b* is formed into a circular plate shape. The edge of the base 1121*b* is coupled to the rear end of the main housing 1110 to seal the motor chamber (S1). The edge of the base 1121*b* is then coupled to the front end of the middle housing 1130.

The main frame-side suction flow paths 11121*c*1 and 1121*c*2 are configured to supply the fluid to be compressed to the compression chamber from the motor part 1150. The main frame-side suction flow paths 11121*c*1 and 1121*c*2 are formed by holes that penetrate the base 1121*b* in an axial direction.

The main frame-side suction flow paths 11121*c*1 and 1121*c*2 may be formed on a position facing the fixed scroll-side suction flow paths 1161*f*1 and 161*f*2 in an axial direction. For example, the main frame-side suction flow paths 11121*c*1 and 1121*c*2 may be formed in a plural number, and a plurality of main frame-side suction flow paths 1121*c*1 and 1121*c*2 may be formed opposite to each other in the axial direction of the rotary shaft 1170 based on the fixed scroll accommodation part 1121*f* formed at the center of the base 1121*b*.

In addition, the main frame-side suction flow paths 11121*c*1 and 1121*c*2 may be formed between the outer edge of the discharge chamber (S2) and the outer edge of the main frame 1120 in the radial direction of the rotary shaft 1170. The outer edge of the discharge chamber (S2) is formed by the partition wall 1121*d* to be described later, and the outer edge of the main frame 1120 corresponds to the outer edge of the base 1121*b*.

The main frame 1120 and the fixed scroll 1161 form the discharge chamber (S2). The discharge chamber (S2) means the area where compressed high-pressure fluid is discharged from the compression part 1160. At least one of the main frame 1120 and the fixed scroll 1161 includes the partition wall 1121*d* to form the outer edge of the discharge chamber (S2). In FIG. 3, the partition wall 1121*d* is shown to be formed on the main frame 1120.

The partition wall 1121*d* protrudes in an annular form from the base of the main frame 1121*b* towards the fixed scroll 1161. The outer diameter of the partition wall 1121*d* is smaller than that of the base 1121*b*. The partition wall 1121*d* has a section in the form of a closed curve to isolate the discharge chamber (S2) from the main frame-side suction flow paths 1121*c*1 and 1121*c*2 and the fixed scroll-side suction flow paths 1161*f*1 and 161*f*2.

Since the center of the main frame 1120 and the fixed scroll 1161 is penetrated by the rotary shaft 1170, the discharge chamber (S2) is formed as an annular shape around the rotary shaft 1170. Thus, in the radial direction of the rotary shaft 1170, the discharge chamber (S2) is formed around the rotary shaft 1170, and inlet flow paths 1121*c*1, 1121*c*2, 1161*f*1, and 1161*f*2 are formed around the circumference of the discharge chamber (S2).

The sealing member accommodation part 1121*e* is formed at the axial end of the partition wall 1121*d*.

The sealing member accommodation part 1121*e* may be formed in the form of a closed curve along the section of the partition wall 1121*d*. The sealing member accommodation part 1121*e* is formed by being recessed in an axial direction at the end of the partition wall 1121*d*. The annular sealing members 1192, 1193, 1194 and 1195 are inserted in the sealing member accommodation part 1121*e* to seal the discharge chamber (S2). The sealing member 1195 may be formed by an o-ring.

The partition wall 1121*d* does not necessarily have to be formed in the main frame 1120 and may be formed in the fixed scroll 1161. In this case, the sealing member accommodation part 1121*e* is also formed in the fixed scroll 1161*e*.

A fixed scroll accommodation part 1121*f* is formed at the center of the base 1121*b*. The fixed scroll accommodation part 1121*f* protrudes in an annular shape from the base 1121*b* towards the motor part 1150. The fixed scroll accommodation part 1121*f* may be formed in a hollow cylindrical shape to enclose the rotary shaft accommodation part 1161*d* inserted into the fixed scroll accommodation part 1121*f*. The sealing member 1192 may be installed on an outer circumferential surface of the rotary shaft accommodation part 1161*d*.

The communication hole 1121*g* is configured to connect the discharge chamber (S2) and the oil separation chamber (S4). The communication hole 1121*g* is formed on the base 1121*b* as a hole opened towards the discharge chamber (S2). The communication hole 1121*g* may be formed in a plural number, and a plurality of communication holes 1121*g* may be formed in a position spaced apart from each other. The high-pressure fluid discharged from the compression chamber into the discharge chamber (S2) flows from the discharge chamber (S2) to the oil separation chamber (S4) through the communication hole 1121*g*.

The oil separator 1121*h* is configured to separate oil from the fluid entering the oil separation chamber (S4) from the discharge chamber (S2). The oil separator 1121*h* is configured to separate the gas-state refrigerant from the liquid-state oil from each other using centrifugal force differences in the rotating fluid.

The oil separation chamber (S4) is configured to collect oil separated by the oil separator 1121*h*. The oil separation chamber (S4) is formed below the oil separator 1121*h*. Therefore, the refrigerant separated by the oil separator 1121*h* is discharged to the outside of the motor-operated compressor 1000 through the discharge part 1121, and the oil is then collected in the oil separation chamber (S4).

The main frame-side oil hole 1121*i* penetrates one side of the main frame 1120 in an axial direction so that the oil collected in the oil separation chamber (S4) is supplied to the fixed scroll-side oil hole 1161*h* of the fixed scroll 1161 and the fixed scroll-side oil feeding flow path 1161*i*. Here, the meaning of penetration of the one side of the main frame 1120 is that the base 1121*b* is penetrated only to the fixed scroll 1161 in the axial direction of the rotary shaft 1170 and not to the motor part 1150.

The main frame-side oil hole 1121*i* is formed in a position that faces the fixed scroll-side oil hole 1161*h* in the axial direction of the rotary shaft 1170. The main frame-side oil hole 1121*i* is formed between the outer edge of the discharge chamber (S2) and the outer edge of the main frame 1120 in the radial direction of the rotary shaft 1170. Here, the outer edge of the discharge chamber (S2) means the partition wall 1121*d*, and the outer edge of the main frame 1120 means the outer edge of the base 1121*b*.

For the supply of oil, the main frame-side oil hole 1121*i* and the fixed scroll-side oil hole 1161*h* have to be connected together. On the other hand, the fixed plate 1161*a* of the fixed scroll 1161 and the base 1121*b* of the main frame 1120 have to be separated from each other for the formation of the discharge chamber (S2). Therefore, for the connection of the main frame-side oil hole 1121*i* and the fixed scroll-side oil hole 1161*h*, at least one of the fixed scroll 1161 or the main frame 1120 must include a projection protruded axially towards the other.

When the protrusion is formed on the main frame 1120, the main frame-side oil hole 1121*i* is formed in the projection. And the protrusion is in close contact with the fixed plate 1161*a*. This allows the main frame-side oil hole 1121*i* to be connected to the fixed scroll-side oil hole 1161*h*.

On the contrary, when the protrusion is formed on the fixed scroll 1161*h*, the fixed scroll-side oil hole 1161*h* is formed in the projection. And the protrusion is in close contact with the base 1121*b*. This allows the main frame-side oil hole 1121*i* to be connected to the fixed scroll-side oil hole 1161*h*.

The side wall 1161*c* of the fixed scroll 1161*c* may protrude from the fixed plate 1161*a* and become closely contacted to the base 1121*b*, so the side wall 1161*c* may function as the projection. In FIG. 3, there is shown that the fixed scroll-side oil hole 1161*h* is formed on the side wall 1161*c* of the fixed scroll 1161*c*.

According to the detailed description of the disclosure, there are following effects.

First, according to the detailed description of the present disclosure, high pressure fluid is discharged from the middle part of the motor-operated compressor 1000. Fluid is discharged between the motor part 1150 and the compression part 1160, reducing the pulsation generated by the motor-operated compressor 1000.

In addition, in the present disclosure, the fluid in the compression process is used for back pressure, rather than reducing the discharge pressure to a intermediate pressure. It is therefore very easy to form the complete intermediate pressure required by the back pressure structure. In addition, separate depressurization devices or decompression flow paths are not required in the process of forming the intermediate pressure, so the structure of the motor-operated compressor 1000 can be simplified.

Further, the present disclosure allows the discharge valve 1163 to be installed in the fixed scroll 1161, which reduces the effects of noise and vibration compared to when the discharge valve 1163 is installed in the orbiting scroll 1162.

The motor-operated compressor described above is not limited to the configurations and the methods of the embodiments described above, but the embodiments may be configured by selectively combining all or part of the embodiments so that various modifications or changes can be made.

According to the detailed description of the present disclosure of the above configuration, compressed fluid is discharged from the compression part between the motor part and the compression part to reduce pulses generated by the motor-operated compressor. This can result in reduced noise and vibration from the motor-operated compressor and, when the motor-operated compressor is fitted to electric vehicles etc., the deterioration of ride comfort delivered to the user may be eliminated.

In addition, the detailed description of the present disclosure does not reduce a discharge pressure to a intermediate pressure, but uses the fluid in the compression process to a back pressure. As a result, it is very easy to form the complete intermediate pressure required by the back pressure structure. In addition, separate depressurization devices or decompression flow paths are not required in the process of forming the intermediate pressure, so the structure of the motor-operated compressor may be simplified.

In addition, the detailed description of the present disclosure allows the discharge valve to be installed in a fixed scroll, which reduces the effects of noise and vibration than when the discharge valve is installed in an orbiting scroll.

What is claimed is:

1. A motor-operated compressor comprising:

a compression part including a fixed scroll and an orbiting scroll configured to form a compression chamber in between the fixed scroll and the orbiting scroll, and compress fluid by an orbiting motion of the orbiting scroll relative to the fixed scroll;

a motor part disposed at one side of the compression part, and configured to generate a drive force to cause the orbiting scroll to make the orbiting motion;

a rotary shaft connected to the motor part and the orbiting scroll, respectively, to transmit the drive force generated by the motor part to the orbiting scroll;

a main frame disposed between the compression part and the motor part in an axial direction of the rotary shaft, and configured to support the fixed scroll in an axial direction of the rotary shaft;

a discharge chamber formed between the fixed scroll and the main frame, and configured to be supplied with fluid discharged from the compression part; and a discharge part formed in the main frame and communicating with outside of the motor-operated compressor and the discharge chamber, respectively, the discharge part being configured to cause fluid discharged from the compression part to the discharge chamber to be discharged to the outside of the motor-operated compressor, wherein the discharge chamber is formed as an annular chamber surrounding the rotary shaft, wherein the main frame includes a main frame-side suction flow path configured to supply fluid to be compressed from the motor part to the compression chamber, and wherein the main frame-side suction flow path is formed between an outer edge of the discharge chamber and an outer edge of the main frame in a radial direction of the rotary shaft.

2. The motor-operated compressor of claim 1, wherein a fixed scroll-side suction flow path is formed at a position that faces the main frame-side suction flow path in the axial direction on a fixed plate of the fixed scroll.

3. The motor-operated compressor of claim 2, wherein at least one of the fixed scroll or the main frame includes a partition wall that forms the outer edge of the discharge chamber, and wherein the partition wall has a section shaped in a form of a closed curve to isolate the discharge chamber from the main frame-side suction flow path and the fixed scroll-side suction flow path.

4. The motor-operated compressor of claim 3, comprising an o-ring disposed in a position at least one of between the fixed plate and the partition wall or between the main frame and the partition wall.

5. The motor-operated compressor of claim 1, wherein the fixed scroll includes a rotary shaft accommodation part configured to surround the rotary shaft, wherein the rotary shaft accommodation part is disposed in the main frame, and wherein a sealing member configured to enclose the rotary shaft accommodation part is disposed between an outer circumferential surface of the rotary shaft accommodation part and an inner circumferential surface of the main frame.

6. The motor-operated compressor of claim 1, wherein the fixed scroll includes a fixed plate, wherein the fixed plate includes a fixed scroll-side discharge flow path configured to discharge the fluid compressed in the compression chamber into the discharge chamber, wherein the motor-operated compressor further includes a discharge valve, and wherein the discharge valve is configured to open and close the fixed scroll-side discharge flow path and disposed between the fixed plate and the main frame.

7. The motor-operated compressor of claim 1, wherein the main frame includes:

an oil separator configured to separate oil from fluid entering the discharge part from the discharge chamber;

an oil separating chamber formed below the oil separator to collect oil separated by the oil separator; and a main frame-side oil hole penetrating through one side of the main frame in the axial direction and configured to supply the oil collected at the oil separation chamber towards the fixed scroll.

8. The motor-operated compressor of claim 7, wherein the discharge chamber is formed as an annular chamber surrounding the rotary shaft, and wherein the main frame-side oil hole is formed between an outer edge of the discharge chamber and an outer edge of the main frame in a radial direction of the rotary shaft.

9. The motor-operated compressor of claim 7, wherein a rotary shaft-side oil feeding flow path is formed in a hollow part of the rotary shaft, and wherein the fixed scroll includes a fixed scroll-side oil feeding flow path configured to supply oil supplied from the oil separation chamber through the oil hole to the rotary shaft-side oil feeding flow path, and wherein the fixed scroll-side oil feeding flow path passes through the fixed plate of the fixed scroll in a radial direction of the rotary shaft, an inlet of the fixed scroll-side oil feeding flow path is disposed to face the main frame-side oil hole in the axial direction, and an outlet of the fixed scroll-side oil feeding flow path is disposed to face an inlet of the rotary shaft-side oil feeding flow path in the radial direction of the rotary shaft.

10. The motor-operated compressor of claim 9, wherein at least one of the fixed scroll or the main frame includes a projection protruding towards the other of the fixed scroll or the main frame in the axial direction of the rotary shaft, and at least one of an inlet of the oil hole or the inlet of the rotary shaft-side oil feeding flow path is formed in the projection.

11. The motor-operated compressor of claim 10, wherein the projection is formed on an outside of the discharge chamber in the radial direction of the rotary shaft.

12. The motor-operated compressor of claim 10, further comprising:

a main housing exposed to the outside of the motor-operated compressor and configured to enclose the motor part; and a middle housing exposed to the outside of the motor-operated compressor and configured to enclose the compression part, and wherein the main frame is exposed to the outside of the motor-operated compressor between the main housing and the middle housing in the axial direction, and configured to form an external appearance of the motor-operated compressor together with the main housing and the middle housing.

13. The motor-operated compressor of claim 10, further comprising a rear housing, wherein the rear housing is configured to cover the orbiting scroll and disposed opposite to the fixed scroll with respect to the orbiting scroll, to form an intermediate pressure chamber between the rear housing and an orbiting plate of the orbiting scroll, wherein the orbiting plate includes an intermediate pressure discharge flow path, and wherein the intermediate pressure discharge flow path is configured to provide communication between the compression chamber and the intermediate pressure chamber to discharge fluid of an intermediate pressure between suction pressure and discharge pressure of the fluid from the compression chamber to the intermediate pressure chamber.

14. A motor-operated compressor comprising:

a compression part including a fixed scroll and an orbiting scroll configured to form a compression chamber in between the fixed scroll and the orbiting scroll, and compress fluid by an orbiting motion of the orbiting scroll relative to the fixed scroll;

a motor part disposed at one side of the compression part, and configured to generate a drive force to cause the orbiting scroll to make the orbiting motion;

a rotary shaft connected to the motor part and the orbiting scroll, respectively, to transmit the drive force generated by the motor part to the orbiting scroll;

a main frame disposed between the compression part and the motor part in an axial direction of the rotary shaft, and configured to support the fixed scroll in an axial direction of the rotary shaft;

a discharge chamber formed between the fixed scroll and the main frame, and configured to be supplied with fluid discharged from the compression part; and a discharge part formed in the main frame and communicating with outside of the motor-operated compressor and the discharge chamber, respectively, the discharge part being configured to cause fluid discharged from the compression part to the discharge chamber to be discharged to the outside of the motor-operated compressor, wherein the main frame includes:

an oil separator configured to separate oil from fluid entering the discharge part from the discharge chamber;

an oil separating chamber formed below the oil separator to collect oil separated by the oil separator; and a main frame-side oil hole penetrating through one side of the main frame in the axial direction and configured to supply the oil collected at the oil separation chamber towards the fixed scroll.

15. The motor-operated compressor of claim 14, wherein the discharge chamber is formed as an annular chamber surrounding the rotary shaft, and wherein the main frame-side oil hole is formed between an outer edge of the discharge chamber and an outer edge of the main frame in a radial direction of the rotary shaft.

16. The motor-operated compressor of claim 14, wherein a rotary shaft-side oil feeding flow path is formed in a hollow part of the rotary shaft, and wherein the fixed scroll includes a fixed scroll-side oil feeding flow path configured to supply oil supplied from the oil separation chamber through the oil hole to the rotary shaft-side oil feeding flow path, and wherein the fixed scroll-side oil feeding flow path passes through the fixed plate of the fixed scroll in a radial direction of the rotary shaft, an inlet of the fixed scroll-side oil feeding flow path is disposed to face the main frame-side oil hole in the axial direction, and an outlet of the fixed scroll-side oil feeding flow path is disposed to face an inlet of the rotary shaft-side oil feeding flow path in the radial direction of the rotary shaft.

17. The motor-operated compressor of claim 16, wherein at least one of the fixed scroll or the main frame includes a projection protruding towards the other of the fixed scroll or the main frame in the axial direction of the rotary shaft, and at least one of an inlet of the oil hole or the inlet of the rotary shaft-side oil feeding flow path is formed in the projection.

18. The motor-operated compressor of claim 17, wherein the projection is formed on an outside of the discharge chamber in the radial direction of the rotary shaft.

19. The motor-operated compressor of claim 17, further comprising:

a main housing exposed to the outside of the motor-operated compressor and configured to enclose the motor part; and a middle housing exposed to the outside of the motor-operated compressor and configured to enclose the compression part, and wherein the main frame is exposed to the outside of the motor-operated compressor between the main housing and the middle housing in the axial direction, and configured to form an external appearance of the motor-operated compressor together with the main housing and the middle housing.

20. The motor-operated compressor of claim 17, further comprising a rear housing, wherein the rear housing is configured to cover the orbiting scroll and disposed opposite to the fixed scroll with respect to the orbiting scroll, to form an intermediate pressure chamber between the rear housing and an orbiting plate of the orbiting scroll, wherein the orbiting plate includes an intermediate pressure discharge flow path, and wherein the intermediate pressure discharge flow path is configured to provide communication between the compression chamber and the intermediate pressure chamber to discharge fluid of an intermediate pressure between suction pressure and discharge pressure of the fluid from the compression chamber to the intermediate pressure chamber.

* * * * *